US008226809B2

(12) United States Patent
Wang et al.

(10) Patent No.: US 8,226,809 B2
(45) Date of Patent: Jul. 24, 2012

(54) ANODIZED SUBSTRATE LAYER WITH SOLID LUBRICANT

(75) Inventors: Yucong Wang, West Bloomfield, MI (US); Fengyuan Yan, Lanzhou (CN); Jianmin Chen, Lanzhou (CN); Xiaobo Wang, Lanzhou (CN)

(73) Assignee: GM Global Technology Operations LLC, Detroit, MI (US)

( * ) Notice: Subject to any disclaimer, the term of this patent is extended or adjusted under 35 U.S.C. 154(b) by 1760 days.

(21) Appl. No.: 11/330,507

(22) Filed: Jan. 12, 2006

(65) Prior Publication Data

US 2007/0158197 A1 Jul. 12, 2007

(51) Int. Cl.
*C25D 5/02* (2006.01)

(52) U.S. Cl. ..... 205/121; 205/173

(58) Field of Classification Search ..... 205/121, 205/173

See application file for complete search history.

(56) References Cited

U.S. PATENT DOCUMENTS 3,920,468 A * 11/1975 Brown et al. ..... 205/316
4,230,539 A * 10/1980 Saruwatari et al. ..... 205/223

FOREIGN PATENT DOCUMENTS

JP 05112096 A 5/1993
JP 05112097 A 5/1993
JP 2004043730 A 2/2004

OTHER PUBLICATIONS

Daniel Belanger, Guylaine Laperriere and Benoit Marson, The Electrodeposition of Amorphous Molybdenum Sulfide (Received May 19, 1992; in revised form Aug. 12, 1992), J. Electroanal, Chem., 347 (1993) pp. 165 to 183.

Daniel Belanger, Guylaine Laperriere, Francois Girard, Daniel Guay and Gerad Tourillon, Physicochemical Characteristics of Electrochemically Deposited Molybdenum Sulfide and Polypyrrole-Tetrathiomolybdate/Molybdenum Trisulfide Composite Electrodes, Received Sep. 10, 1992, revised Manuscript Received Apr. 9, 1993, Chem. Mater. 1993, 5, pp. 861-868.

* cited by examiner

*Primary Examiner* — Luan Van

(57) ABSTRACT

An anodized layer on a metallic substrate is treated in a manner to directly electrodeposit a metal sulfide solid lubricant material represented by $MS_2$, where M is Mo, W or other suitable metal, in pores of the anodized layer without any subsequent thermal and/or chemical treatment being needed.

8 Claims, 5 Drawing Sheets

ANODIZED SUBSTRATE LAYER WITH SOLID LUBRICANT

FIELD OF THE INVENTION

The present invention relates to anodized metallic substrates and, more particularly, to inclusion of a metal sulfide in pores of an anodized oxide layer on a metallic substrate.

BACKGROUND OF THE INVENTION

Aluminum and its alloys (aluminum materials) have been widely used in the automotive industry as lightweight materials. However, compared to their generally excellent corrosion resistance in many applications, the tribological properties of aluminum materials limit their use in certain applications, especially where adhesive wear and abrasive wear properties are required.

A variety of surface treatments have been evaluated to improve wear resistance of aluminum materials. One such widely used treatment involves anodizing the aluminum material to form an anodized hard aluminum oxide coating or layer on the surface such that wear resistance is increased. The anodizing treatment may be followed by a treatment to improve the triological performance of the anodized layer. For example, the anodizing treatment may be followed by formation of a solid lubricating phase in the pores of the anodized layer to reduce the friction coefficient of the anodized layer.

One well known treatment for improving the tribological performance of the anodized oxide layer involves initial formation of $MoS_3$in the pores of the anodized oxide layer. Pursuant to this treatment, the anodized aluminum material is made the anode in an electrolytic cell. The cathode of the cell comprises lead (Pb). The electrolyte comprises an aqueous solution of ammonium thiomolybdenate $(NH_4)_2MoS_4$ in a concentration of about 0.01 mol/L of the solution with the solution having a pH of 7.1 and temperature of 20 degrees C. A current density of about 0.5 A/dm$^2$ is passed through the cell to produce and deposit $MoS_3$ in the pores of the anodized oxide layer. However, the treated anodized oxide layer must then be thermally heat treated to transform the $MoS_3$in the pores to the desired $MoS_2$ solid lubricant. The thermal heat treatment involves heating the anodized and treated aluminum material at a temperature above 400 degrees C. in nitrogen for a time, such as 6 hours, to effect the transformation of $MoS_3$ to $MoS_2$.

Another treatment for improving the tribological performance of the anodized oxide layer involves formation of $MoO_2$ in the pores of the anodized oxide layer followed by vulcanizing the treated anodized layer at elevated temperature in the presence of $H_2S$ gas to convert $MoO_2$ to the desired $MoS_2$ solid lubricant. In this treatment, the anodized aluminum material is made the cathode in an electrolytic cell having an aqueous electrolyte containing molybdenate acid radical (e.g. $MO_4^{2-}$). When electrical current is passed between the anode and the cathode of the cell, the radical is reduced to form and deposit a $MoO_2$ synthesis product in the pores of the anodized layer. The treated anodized layer must then be subjected to a vulcanization reaction at an elevated temperature above 500 degrees C. in an atmosphere containing $H_2S$ gas to transform the $MoO_2$in the pores to the desired $MoS_2$ solid lubricant.

SUMMARY OF THE INVENTION

The invention provides in one embodiment a method of treating an anodized layer on a metallic substrate to directly electrodeposit a metal sulfide represented by $MS_2$, where M is a suitable metal, in pores of the anodized layer. The metallic substrate typically comprises aluminum, magnesium, or any other anodizable metal or alloy.

In an illustrative embodiment of the invention, the anodized substrate is made the cathode in an electrolytic cell having an electrolyte containing precursor acid radicals of the metal sulfide dissolved therein and the precursor radicals are reduced at the cathode to directly electrodeposit the metal sulfide $MS_2$ (e.g. $MoS_2$, $WS_2$, etc.): in pores of the anodized layer on the substrate. An exemplary precursor acid radical comprises $MS_4^{2-}$ (thiomolybdate) where M is the metal, such as for example tetrathiomolybdate, $MOS_4^{2-}$.

The invention provides in another embodiment a metallic substrate that includes an anodized oxide layer thereon having metal sulfide-represented by $MS_2$ directly electrodeposited in pores thereof. The presence of the metal sulfide in the pores improves the tribological performance of the anodized substrate.

The invention provides in still another embodiment a method of making diammonium tetrathiomolydate for use in the electrolyte as well as for other uses.

The invention can be practiced to treat anodized metallic substrates comprising aluminum, magnesium or any other anodizable metal or alloy to improve tribological performance. Other advantages and features of the present invention will become apparent from the following description.

DESCRIPTION OF THE INVENTION

Figure 1A:
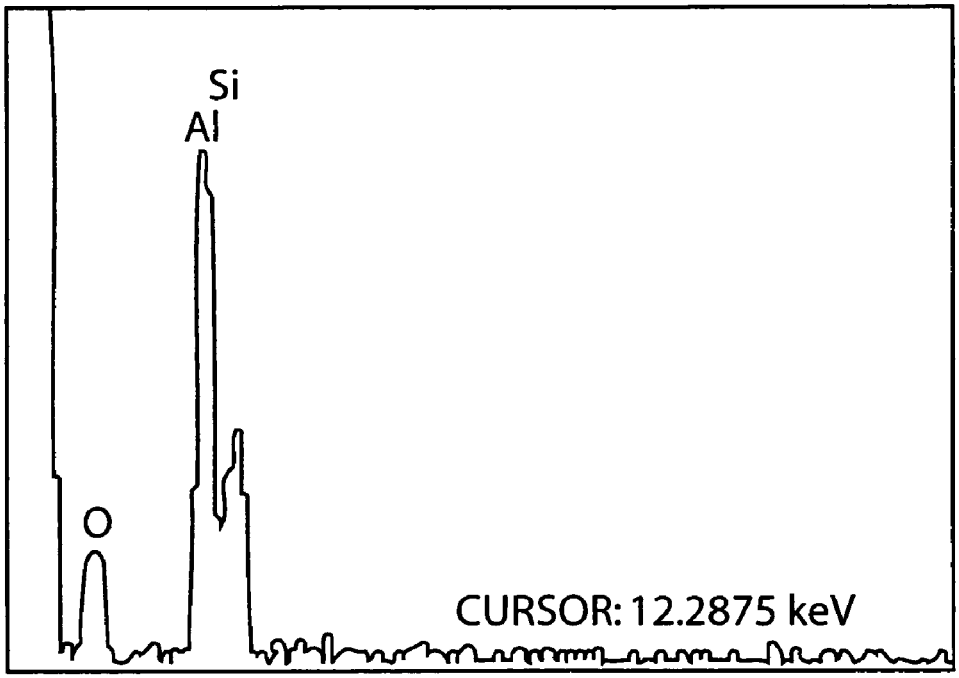
FIG. 1A represents the result of energy-dispersive spectroscopic (EDS) analysis of an anodized oxide layer on 390 aluminum alloy without treatment pursuant to the invention.

The invention involves the direct electrodeposition of a metal sulfide in pores of an anodized oxide layer formed on a metallic substrate. Practice of the method of the invention is advantageous to produce a treated anodized oxide layer having metal sulfide solid lubricant in the pores thereof without the need for a subsequent thermal and/or chemical treatment of the treated anodized oxide layer. The invention is especially useful in treating an anodized oxide layer on a substrate that comprises aluminum or magnesium (e.g. anodized aluminum substrate, anodized aluminum alloy substrate, anodized magnesium substrate, or anodized magnesium alloy substrate) although the invention is not limited to such substrates and can be practiced in connection with any anodizable metal or alloy substrate where an anodic oxide layer can be formed on the surface thereof in an electrolytic cell. Although certain embodiments of the invention are described below in connection with a known hyper-eutectic Al—Si 390 aluminum alloy for purposes of illustration, the invention is not so limited as is apparent from the above discussion. The nominal composition of 390 aluminum alloy comprises 16-18 weight % Si, about 4 weight %, Cu, and balance other minor elements and Al.

The invention is not limited to any particular anodizing treatment process for forming the anodized oxide layer on the substrate. For example, the anodizing process can vary with the particular type of metallic substrate to be anodized and the particular type of anodized oxide layer to be formed. The properties of the anodized oxide layer can be varied by selecting an appropriate electrolyte in which the anodic oxide layer is formed on the substrate. For example, the wear resistance of anodized aluminum formed in oxalic acid is better than that formed in sulfuric acid. Moreover, the properties of the anodized oxide layer prepared in the same electrolyte will depend on the electrolyte concentration and temperature and the electrical current density of anodic oxidation. The anodic aluminum oxide layers are characterized as porous in that they typically have a network of voids or pores throughout the oxide layer. Moreover, the anodized oxide layer may include other elements that are present in the substrate composition. For example, when an Al—Si aluminum alloy is anodized, the anodic oxide layer comprises aluminum oxide having Si therein.

Various exemplary anodizing pretreatments and processes with which the invention can be practiced are described below for purposes of illustration and not limitation. However, the invention is not limited to any particular anodizing pretreatment, or to any particular anodizing process or electrolyte.

Prior to anodizing, the substrate typically is pretreated, although in some situations a pretreatment may be unnecessary or optional. Any suitable conventional pretreatment process can be used to provide a substrate surface suitable for anodizing.

For purposes of illustration and not limitation, an exemplary pretreatment process employed to prepare 390 aluminum alloy substrate samples for anodizing involves cleaning the samples by water or organic solvent, such as petroleum ether, and dipping them in 10% by weight NaOH aqueous solution at 50 degrees C. for a period of time (e.g. two minutes). The substrate samples then are rinsed one or more times (e.g. 2-3) in distilled water. The substrate samples then are chemically polished in a solution containing 60% by volume of nitric acid and 20% by volume of hydrofluoric acid at 40 degrees C. for 0.5 to 2 minutes, followed by rinsing in running distilled water for two minutes.

As mentioned above, the pretreated substrate can be anodized using any suitable anodizing process and electrolyte. For purposes of illustration and not limitation, several anodizing processes and electrolytes are described below which are suitable for anodizing 390 aluminum alloy substrates. Exemplary aqueous electrolyte compositions and appropriate cell parameters of temperature, current density, and duration are as follows:

Electrolyte No. 1 is an aqueous sulfuric acid solution where sulfuric acid is present in an amount of 100 to 200 g/L of the solution. The electrolyte temperature is 10-15 degrees C. Current density is 1-3 A/dm$^2$. Duration of anodizing is 60-240 minutes.

Electrolyte No. 2 is an aqueous oxalic acid solution where oxalic acid is present in an amount of 40 to 100 g/L of the solution. The electrolyte temperature is 15-25 degrees C. Current density is 1-3.5 A/dm. Duration of anodizing is 20-200 minutes.

Electrolyte No. 3 is an aqueous mixture of sulfuric acid, oxalic acid, and tartaric acid solution where sulfuric acid is present in an amount of 175 to 205 g/L of the solution, oxalic acid is present in an amount of 10 to 20 g/L of the solution, and tartaric acid is present in an amount of 10 to 20 g/L of the solution. The electrolyte temperature is 10-20 degrees C. Current density is 1-3 A/dm. Duration of anodizing is 20-100 minutes.

Electrolyte No. 4 is an aqueous chromic acid solution where chromic acid is present in an amount of 40 to 50 g/L of the solution. The electrolyte temperature is 30-35 degrees C. Current density is 1-4 A/dm$^2$. Duration of anodizing is 10-60 minutes.

For purposes of further illustration and not limitation, an exemplary anodizing process employed to form an anodic oxide layer on the 390 aluminum alloy substrate samples tested below involves placing the pretreated substrate sample as an anode in a conventional electrolytic cell having a lead (Pb) cathode mounted on a stainless steel cathode holder. The anode and cathode electrodes are immersed in the electrolyte No. 2 at an electrolyte temperature of 10 to 25 degrees C. A constant current density in the range of 1-3.5 A/dm$^2$ is applied between the electrodes using a conventional power source for a time that usually is 20 minutes to 180 minutes to form an anodic oxide layer having a thickness in the range of about 5 to about 25 micrometers. Alternately, a constant voltage can be applied across the electrodes. After anodizing, the substrate samples are removed from the electrolyte, rinsed in flowing distilled water for 30 minutes and dried in air at room temperature (ambient temperature).

The anodized oxide layer formed on the anodized substrates then-is subjected to a treatment pursuant to the invention in a manner to directly electrodeposit a metal sulfide represented by $MS_2$, where M is a suitable metal, in the pores of the anodized oxide layer. The metal can comprise a refractory metal such as preferably Mo or W, or any other metal. As will become apparent below, the presence of such metal sulfide in the pores provides a solid lubricant action that improves tribological performance of the anodized substrate treated pursuant to the invention.

Pursuant to an illustrative embodiment of the treatment of the invention, the anodized substrate is made the cathode of an electrolytic cell having an inert anode, such as graphite and a conventional power source connected to the cathode and anode. The anode and the cathode are immersed in or otherwise contacted with an electrolyte having precursor radicals of the metal sulfide dissolved therein. The electrolytic cell is operated in a manner to reduce the precursor radicals to the metal sulfide $MS_2$ at the cathode (substrate) so as to directly deposit the metal sulfide in the pores of the anodized oxide layer. At the cathode (substrate), the precursor radicals are reduced by receiving electrons and protons ($H^+$) to form the metal sulfide in-situ at the cathode and thereby in the pores of the anodic oxide layer on the substrate.

For purposes of further illustration and not limitation, an exemplary treatment process employed to treat an anodic oxide layer previously formed on 390 aluminum alloy substrate involves placing the anodized substrate sample as the cathode in the-second electrolytic cell having a graphite anode. The anode and cathode electrodes are immersed in an electrolyte comprising an aqueous solution of $[NH_4]_2[MoS_4]$ present in an illustrative amount of 0.001 to 0.01 mol/L of solution and KCl (or any other suitable salt) present in an illustrative amount of 0.05 to 0.2 mol/L of solution with the solution having a pH of about 7.1. Other illustrative amounts of $[NH_4]_2[MoS_4]$ and KCl are set forth in the examples below. The KCl functions as the support electrolyte to carry electrical current through the cell electrolyte. The $[NH_4]_2[MOS_4]$ component of the electrolyte is made pursuant to another embodiment of the invention described below. The electrolyte typically is at a temperature of 25-35 degrees C.

Direct electrodeposition of the metal sulfide ($MoS_2$ in this illustration) is achieved by applying an electrical potential of −1.3 to −2.0 V to the cathode (substrate). Electrodeposition is carried out at a constant current density in the range of about 0.5-1 A/dm$^2$ between the anode and the cathode for a time of 3 minutes to 150 minutes where a shorter time deposits less $MoS_2$ at the cathode. As mentioned, the precursor ions ($MoS_4^{2-}$ in this illustration) are reduced by receiving electrons and protons ($H^+$) effective to form the metal sulfide in-situ at the cathode and thereby in the pores of the anodic oxide layer on the substrate. The electrochemical reduction reaction at the cathode (substrate) to directly electrodeposit $MoS_2$ in the pores of the anodized layer on the substrate (cathode) is as follows in this illustration:

$$MoS_4^{2-}+2e^-+4H^+ = MoS_2+2H_2S$$

After the direct electrodeposition of the $MoS_2$ in the pores of the anodized oxide layer, the substrate samples are rinsed in distilled water and dried in vacuum.

The ammonium tetrathiomolybdate, $[NH_4]_2[MoS_4]$, component of the electrolyte is made pursuant to another embodiment of the invention. For example, the diammonium tetrathiomolydate is made by dissolving a soluble molybdenate in an ammonium hydroxide solution, saturating the solution with hydrogen sulfide gas at ambient temperature, raising the temperature of the solution to a superambient temperature where diammonium tetrathiomolydate reaction product is formed, cooling the solution to precipitate out the diammonium tetrathiomolydate reaction product, and, separating the precipitated ammonium tetrathiomolydate reaction product from the solution.

For purposes of illustration and not limitation of this embodiment, the soluble molybdenate is provided by dissolving 120 grams of $Na_2MoO_4.2H_2O$ in a mixture of concentrated $NH_4OH$ (600 ml) and $H_2O$ (400 ml). The solution is then filtered. $H_2S$ gas is bubbled rapidly into the solution until it is saturated at room temperature (ambient temperature), and then the temperature of the solution is raised to 60 degrees C. while maintaining a relatively slow stream of $H_2S$ gas (flow rate of 20 ml/min). The superambient temperature can be in the range of 30 to 80 degrees C. After 12 hours, the solution is cooled to 0 degrees C. and held there for 30 minutes to precipitate the reaction product. Then, the solid reaction product, $[NH_4]_2$ $[MoS_4]$, is filtered out, washed three times with ethanol, and one time with $Et_2O$ (aether) and dried in vacuum.

Samples were examined after treatment pursuant to the invention to confirm the presence of $MoS_2$ in the pores. For example, FIG. 1B represents the result of energy-dispersive spectroscopic (EDS) analysis of the outer surface of the anodized oxide layer on a 390 aluminum alloy substrate sample treated pursuant to the invention (e.g. samples anodized at 20 degrees C. and a constant current density of 2 A/dm$^2$, in the electrolyte No. 2 for 2 hours, then electrolyzing as cathode for 10 min at a current density of 0.5 A/dm$^2$ at 25 degrees C., in a solution containing 0.001 mol/L $[NH,]_2$ $[MoS_4$and 0.1 mol/L KCl). The elements Al, O, Si, Mo and S are detected on the substrate sample surface treated pursuant to the invention.

Figure 1B:
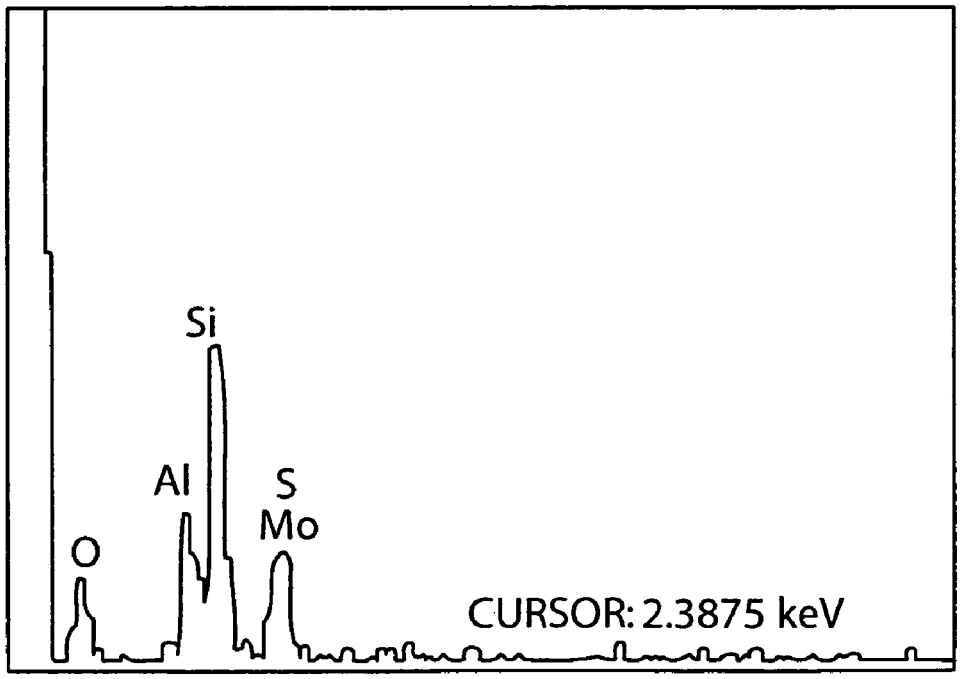
FIG. 1B represents the result of EDS analysis of an anodized oxide layer on 390 aluminum alloy treated pursuant to the invention.

For comparison, FIG. 1A represents the result of EDS analysis of a similarly formed anodized oxide layer on a 390 aluminum alloy substrate sample but that was not further treated after anodization. Only the elements Al, O, and Si are detected in this substrate sample.

Figure 2A:
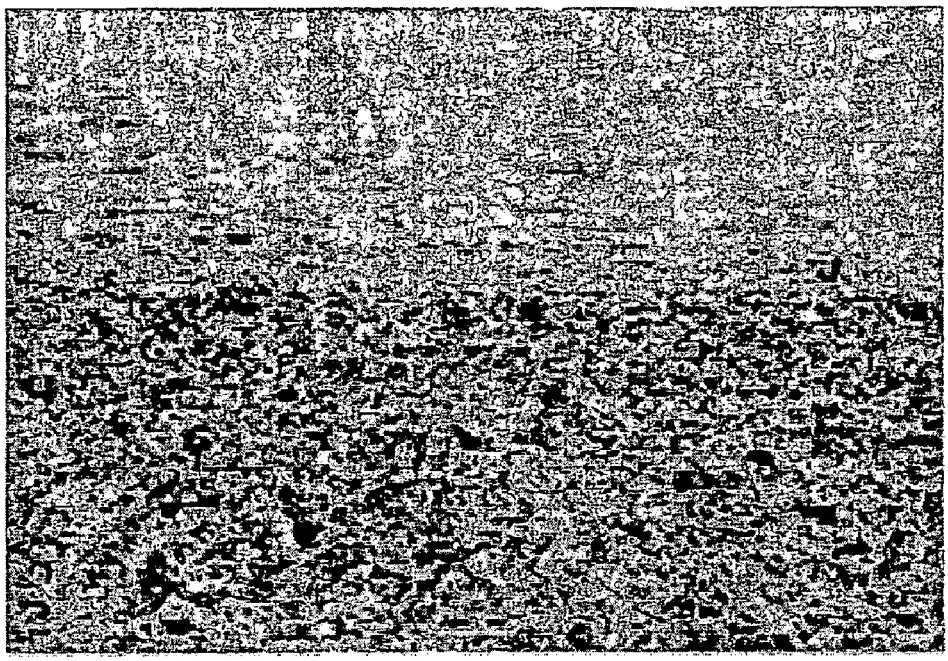
FIG. 2A and 2B are scanning electron micrographs at two different magnifications (100× and 500×, respectively) of a cross-section of an anodized oxide layer on 390 aluminum alloy treated pursuant to the invention.
Figure 2B:
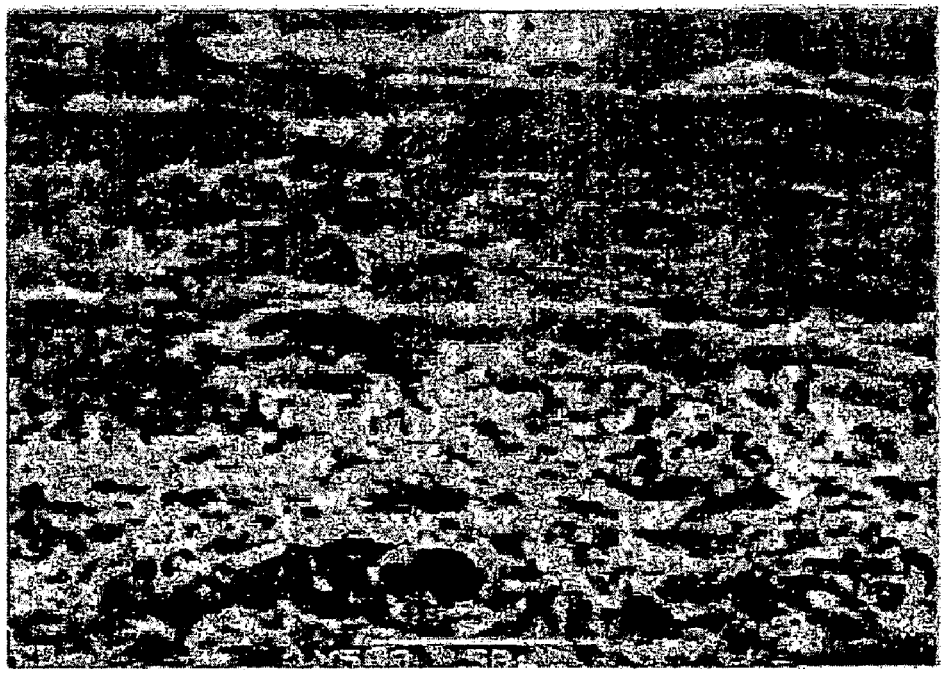

FIG. 2A and 2B are scanning electron micrographs at two different magnifications (100× and 500×, respectively) of a cross-section of an anodized oxide layer on 390 aluminum alloy wherein the pores are filled with $MoS_2$ (darker material) pursuant to the invention (e.g. sample anodized and cathodically treated as described in previous paragraph.

Figure 3:
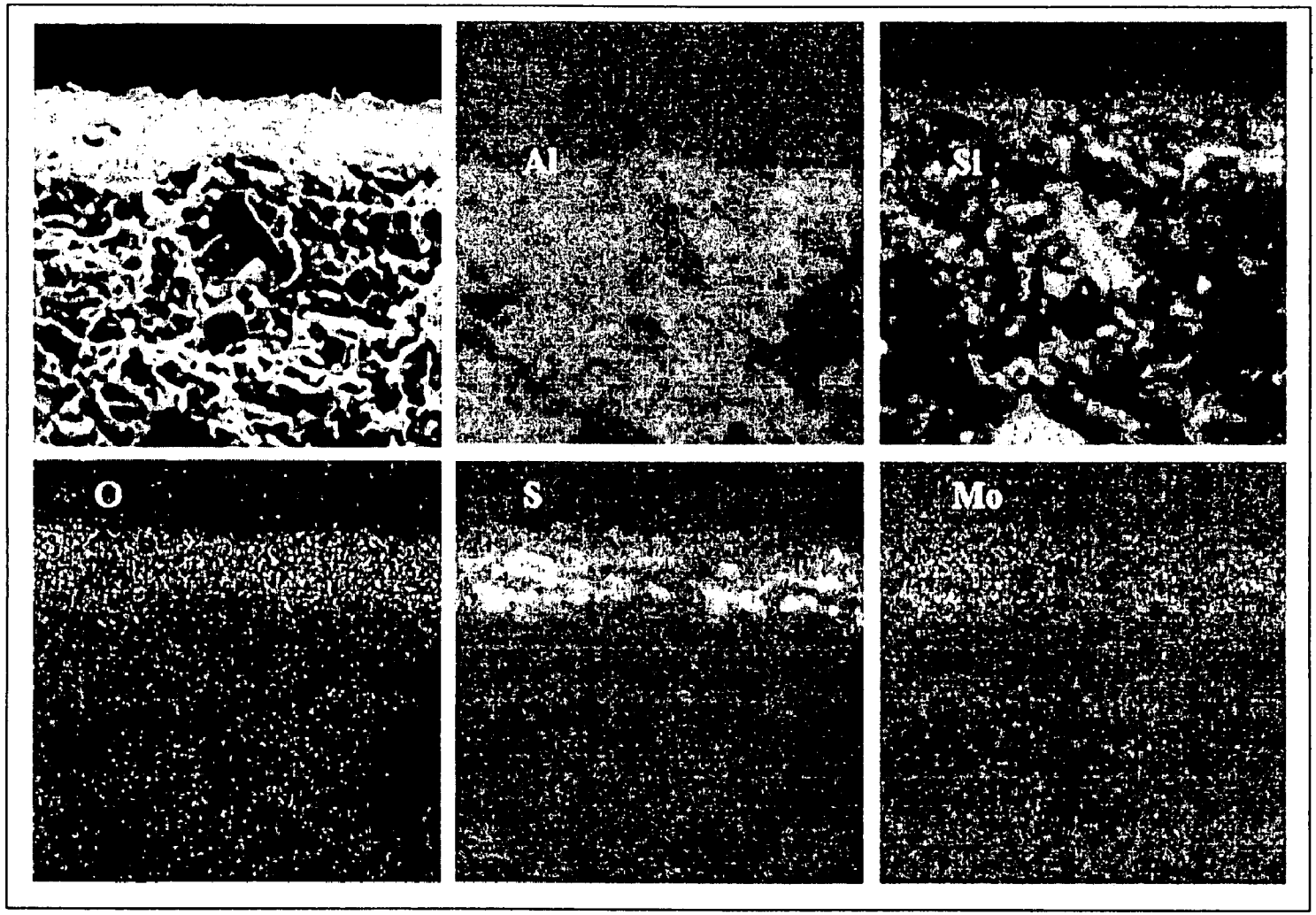
FIG. 3 represents element mapping showing distribution of Al, Si, O, S and Mo at different depths through the thickness of a treated anodized oxide layer on a 390 aluminum alloy substrate shown in section in the upper left corner of the figure wherein the top surface of the anodized layer is at the top of each mapping image.

Referring to FIG. 3, images of the distribution of Al, Si, O, S and Mo at different depths through the thickness of an anodized oxide layer and underlying 390 aluminum alloy substrate (as shown in section in the upper left corner) wherein the oxide layer is treated pursuant to the invention (e.g. 390 aluminum alloy substrate samples anodized and cathodically treated as described in previous paragraph and wherein the top surface of the oxide layer is at the top of each image. This element mapping of the cross-section of the treated anodic oxide layer and substrate shows distributions of S and Mo, which indicate that $MoS_2$ material is distributed throughout the anodic oxide layer and not in the silicon phase of the oxide layer. The $MoS_2$ is present in the pores through the thickness of the anodized layer from an outer surface thereof to an interface where the anodized layer meets the 390 substrate. The amount of S and Mo is somewhat higher at the interface of the substrate and the anodic oxide layer than at the outer surface of the anodic oxide layer.

Figure 4:
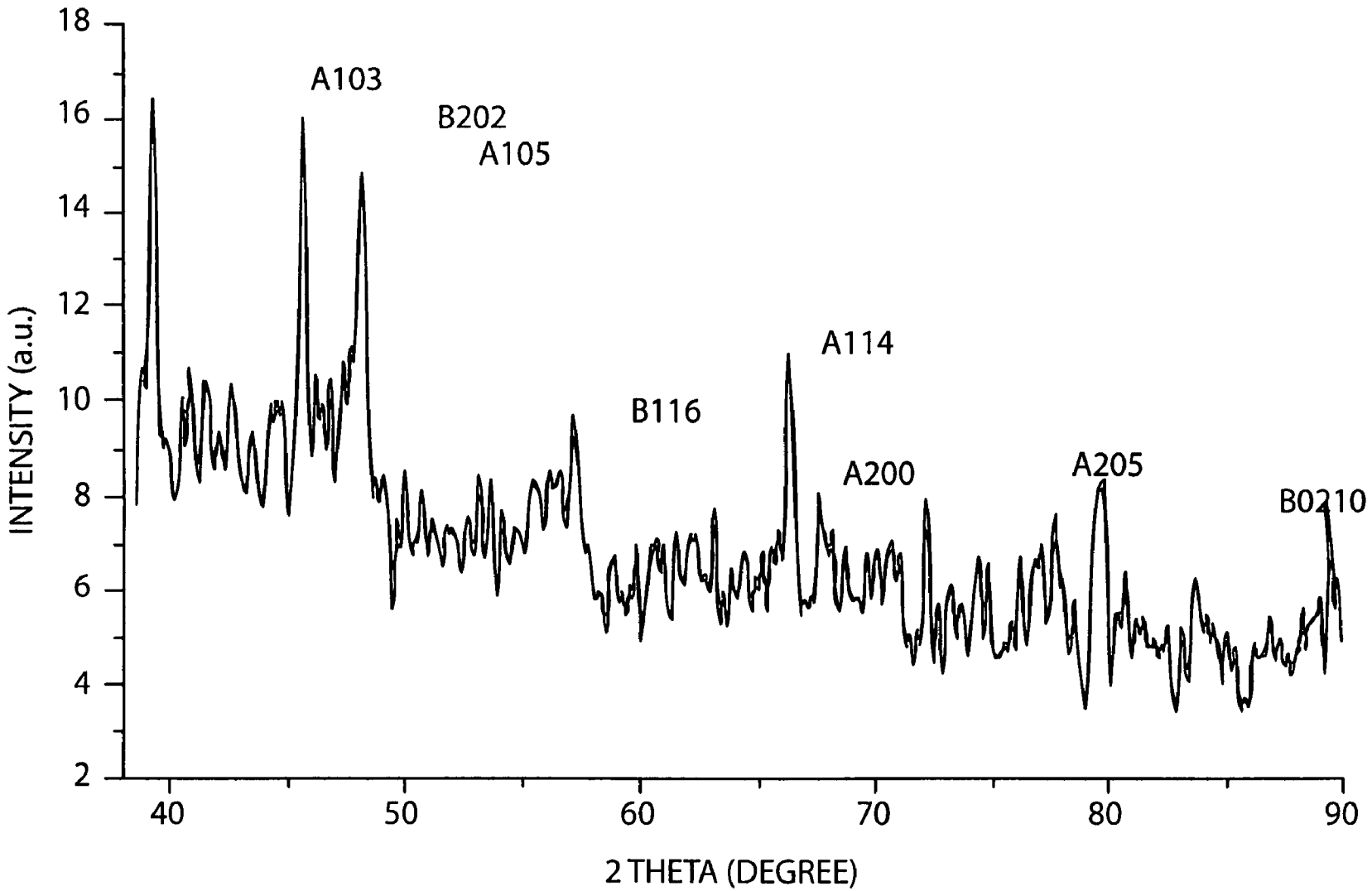
FIG. 4 is an x-ray diffraction (XRD) analysis of the surface of an anodized oxide layer on 390 aluminum alloy substrate.

The crystal structure of the $MoS_2$ deposited in the pores of the anodic oxide layer was investigated by conducting an X-ray diffraction (XRD) analysis of the surface of an anodized 390 alloy substrate treated pursuant to the invention (e.g. sample anodized and cathodically treated as described in previous paragraph. The XRD (Xray diffraction) analysis of FIG. 4 reveals characteristic diffraction peaks of $Al_2O_3$ (103), (105), (114), (200) and (205) as well as characteristic diffraction peaks of $MoS_2$ (202), (116) and (021) that confirm the presence of $Al_2O_3$and $MoS_2$. The peaks for $MoS_2$were widened to an extent indicating the formation of $MoS_2$ in the micro-crystal form. Energy-dispersive spectroscopy (EDS) also confirmed the presence of Al, O, Si, S, and Mo where the atomic ratio of S and Mo is 2:1 indicating the presence of $MoS_2$. Formation of $MoS_2$also was confirmed by X-ray photoelectron spectroscopy (XPS) where the peaks for $MoS_2$positioned at 228.9 and 232.0 eV were detected at all depths into the anodized oxide layer treated pursuant to the invention.

Friction and wear tests were carried out on the anodized 390 alloy substrate samples treated pursuant to the invention (e.g samples anodized and cathodically treated as described in previous paragraph) The friction and wear tests were carried out on a reciprocal friction tester available commercially as RFT-3 reciprocating friction tester made by KYDWA R&D LTD. The test conditions employed were a load of 30N, a speed of 500 rpm (0.83 m/s), temperature of 20 degrees C., and counterpart of 1045 carbon steel and represented an oil starved lubricating condition during testing.

Figure 5:
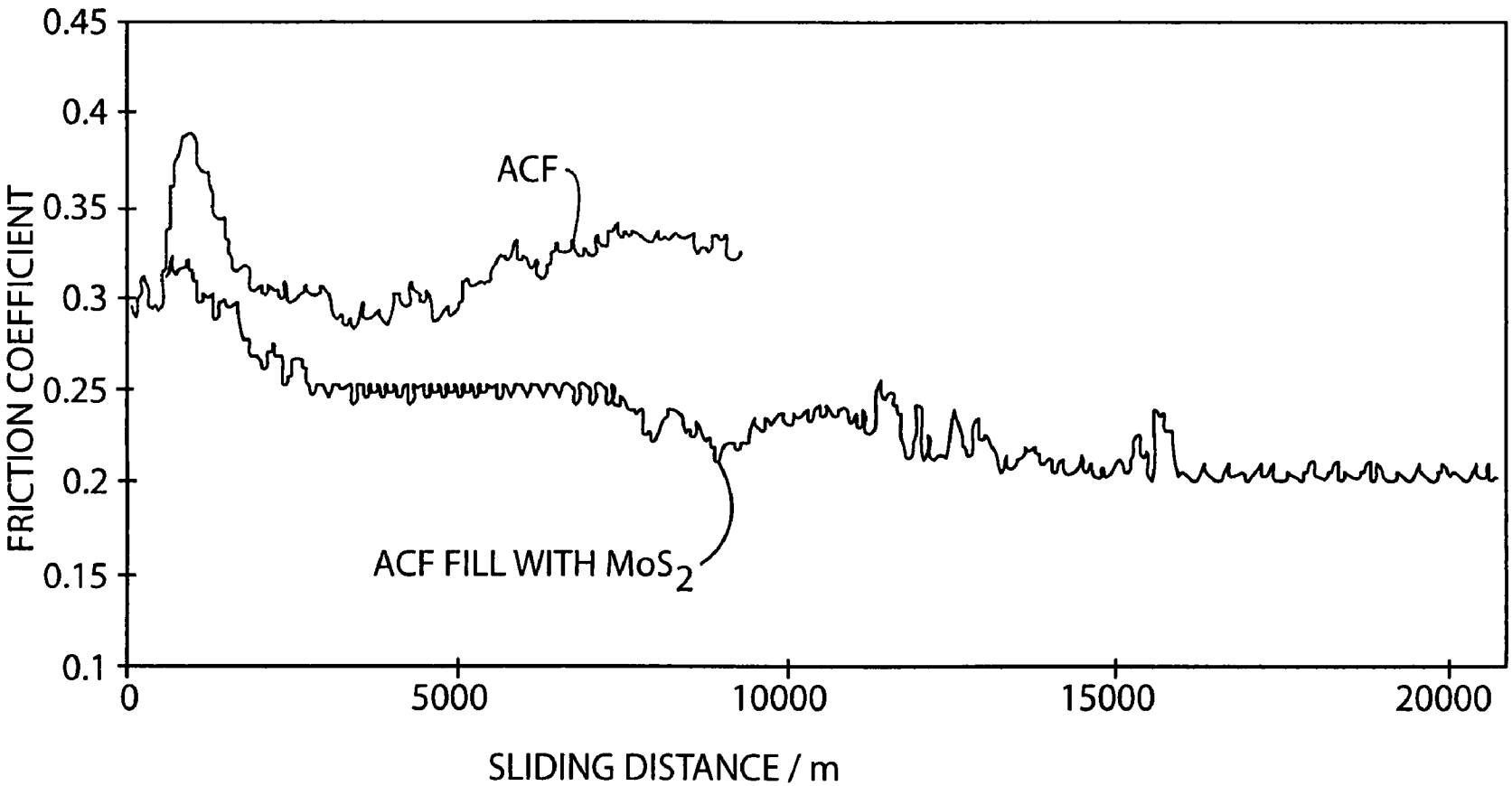
FIG. 5 shows graphs of friction coefficient versus sliding distance (in meters) for an anodized oxide layer on 390 aluminum alloy treated pursuant to the invention (designated "ACF FILL WITH $MoS_2$") and, for comparison, an anodized oxide layer on 390 aluminum alloy not treated pursuant to the invention (designated "ACF").

Referring to FIG. 5, a graph of friction coefficient versus sliding distance for the anodized oxide layer on 390 aluminum alloy samples treated pursuant to the invention (designated by "ACF FILL WITH $MoS_2$") is shown. For comparison, a similar graph is shown for an anodized oxide layer on an anodized 390 aluminum alloy sample not treated pursuant to the invention (designated by "ACF").

FIG. 5 reveals that sample "ACF FILL WITH $MoS_2$" pursuant to the invention exhibited a self-lubricating initial phase or stage where the friction coefficient gradually decreased followed by a relatively stable friction coefficient phase or stage where the friction coefficient was much lower than that of the untreated comparison sample "ACF". The treated anodized oxide layer of sample "ACF FILL WITH $MoS_2$" was not worn through after 19,000 meters of sliding distance and was at least twice as durable as the anodized oxide layer of the untreated sample "ACF".

FIG. 5 reveals that the invention is advantageous to improve the tribological performance of the anodized oxide layer on the aluminum alloy substrate samples. The invention envisions treating anodized aluminum alloy engine components such as, for purposes of illustration and not limitation, engine piston ring grooves, aluminum alloy cylinder bores as well as other engine components and non-engine components made of aluminum or alloys thereof. For example, engine pistons are usually made of the hyper-eutectic 390 aluminum alloy or eutectic 413 aluminum alloy. Cylinder blocks typically are made of eutectic 356 or 319 aluminum alloy. These alloys can be anodized and treated pursuant to the invention. Moreover, the invention envisions treating anodized magnesium or other anodized metals or alloys to improve tribological performance.

It should be understood that the invention is not limited to the specific embodiments or constructions described above but that various changes may be made therein without departing from the spirit and scope of the invention as set forth in the appended claims.

The invention claimed is:

1. Method of treating an anodized layer on a metallic substrate, comprising making the substrate a cathode of an electrolytic cell and directly electrodepositing a metal sulfide represented by $MS_2$, where M is a metal, in pores of the anodized layer by electrolytically reducing at the cathode dissolved precursor radicals of the metal sulfide present in an electrolyte of the electrolytic cell.

2. The method of claim 1 wherein the precursor radicals comprise $MS_4^{2-}$ where M is said metal.

3. The method of claim 2 wherein diammonium tetrathiomolybdate material is dissolved in the electrolyte to provide $MoS_4^{2-}$ radicals therein.

4. The method of claim 1 including dissolving a salt in the electrolyte to provide a support electrolyte.

5. The method of claim 1 wherein the precursor radicals are electrolytically reduced at the cathode by providing a substantially constant current or a substantially constant voltage between the cathode and an anode of the electrolytic cell.

6. The method of claim 1 wherein the substrate comprises aluminum, magnesium, or other anodizable metal.

7. The method of claim 1 wherein the metal M is a refractory metal.

8. The method of claim 7 wherein the refractory metal M is Mo or W.

* * * * *